United States Patent [19]

Crochet

[11] 3,952,983

[45] Apr. 27, 1976

[54] DEVICE FOR RAISING A CHAIR

[76] Inventor: Alain Crochet, "La Jordonniere", St-Pierre d'Entremont, 61800 Tinchebray, France

[22] Filed: Mar. 21, 1975

[21] Appl. No.: 560,862

[30] Foreign Application Priority Data

Mar. 27, 1974 France ..... 74.10479

[52] U.S. Cl. ..... 248/173; 248/23; 248/346; 297/134

[51] Int. Cl.[2] ..... F16M 11/38

[58] Field of Search ..... 297/130, 133, 345, DIG. 4, 297/134; 248/23, 172, 173, 431, 346

[56] References Cited

UNITED STATES PATENTS

| | | | |
|---|---|---|---|
| 878,043 | 2/1908 | Chrisman | 248/23 X |
| 2,669,289 | 2/1954 | Usher et al. | 248/172 X |
| 3,215,382 | 11/1965 | Stein | 248/172 |

FOREIGN PATENTS OR APPLICATIONS

| | | | |
|---|---|---|---|
| 82,661 | 10/1953 | Norway | 248/346 |

*Primary Examiner*—James C. Mitchell
*Attorney, Agent, or Firm*—Cushman, Darby & Cushman

[57] ABSTRACT

The invention concerns a device for raising a chair, for children's use, comprising a cross-beam assembly including articulatedly interconnected telescopic cross-beams, spring means associated with each cross-beam, a leg secured to each end of each cross-beam, and means on the normally upper part of each leg for engaging the leg of a chair that is to be mounted and held on the device, the cross-beams being telescopically extensible against the force of the spring.

1 Claim, 4 Drawing Figures

DEVICE FOR RAISING A CHAIR

BACKGROUND OF THE INVENTION

This invention has for its aim a device for raising a chair comprising cross-members connected to each other by articulation and each carrying at each of its ends a rigidly connected leg which at its upper part has means for gripping the leg of a chair.

The problem frequently arises in the home or when travelling of lifting a child to a convenient height in relation to a table. This problem is in general solved by makeshift means such as cushions, books laid on a chair or by portable seats added to the back of a chair. These do not possess great stability and it is not easy to get near a table with them.

From French Pat. No. 616481 there is known a support for raising a child's armchair. But this support is adaptable for use only with the armchair for which it was designed, which makes it necessary, in the case of travelling, to take along on the trip the cumbersome assembly constituted by the armchair and its support.

The aim of the invention is to propose a device which is adaptable for all kinds of seats, the mounting of which is simple and quick, which is easy to transport, is convenient for all ages and, should the need arise, can support the weight of an adult.

SUMMARY OF THE INVENTION

According to the invention there is provided a device for raising a chair comprising a cross-beam assembly including articulatedly interconnected cross-beams, resilient biasing means associated with each cross-beam, a leg secured to each end of each cross-beam, and means on the normally upper part of each leg for engaging the leg of a chair that is to be mounted and held on the device, the cross-beams being extensible in length against the force of the resilient biasing means.

Preferably the means for engaging the leg of a chair is constituted by a base, and an abutment on the base which is shaped to be capable of at least partially surrounding the said leg of a chair.

Advantageously, each said abutment may be disposed on the base oppositely to the direction of action of the force of the resilient means.

Preferably a pivot serves for articulatedly connecting the cross-beams, the pivot having an axis, one end of each resilient means being fixed on said axis.

Each cross-beam may be constituted by two hollow tubes telescopically arranged one within the other, said resilient means being a spring disposed within the tubes.

BRIEF DESCRIPTION OF THE DRAWING

The invention is described, merely by way of example, with reference to the accompanying drawing, wherein.

DESCRIPTION OF THE PREFERRED EMBODIMENT

Figure 1:
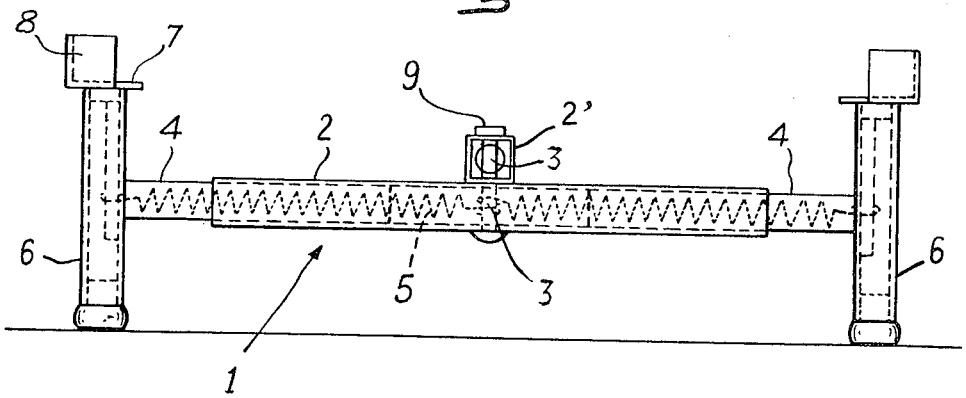
FIG. 1 is an elevation of a preferred embodiment of a chair raising device according to the invention.
Figure 2:
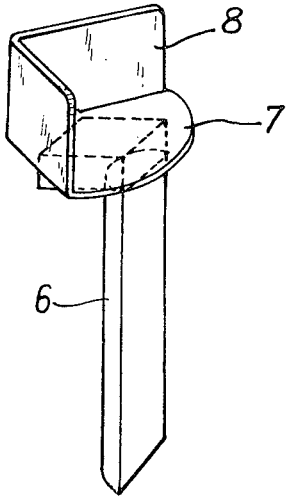
FIG. 2 is perspective view on an enlarged scale of a leg of the device of FIG. 1, and FIGS. 3 and 4 respectively show the configuration in plan view of the device of FIG. 1, respectively adjusted for a chair with a trapezoidal leg array and a square leg array.
Figure 3:
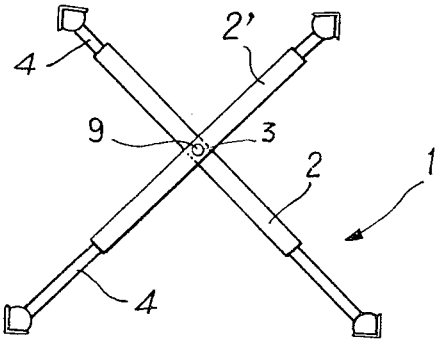
Figure 4:
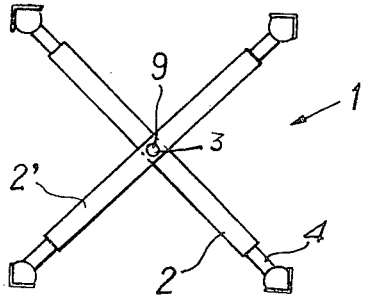

Referring to the drawing, a device for raising a chair designated as a whole by 1 consists of two cross-bar assemblies connected to each other at their central points 3. The cross-bar assemblies are tubular, made of metal or plastics material but are sufficiently rigid to fulfil a true cross-beam function. They are longitudinally extensible and each is constituted to this end by a principal tube 2, or 2', and two tubes 4 which slide without play telescopically inside, and project beyond the extremities of, the central tube 2 or 2'. A respective coil spring 5 is stretched and held between one external end of each tube 4 and the central point 3 to urge the tubes 2 or 2' and 4 towards each other. The outer ends of the tubes 4 each carry a leg 6 which has a length of 5 to 20 centimeters, according to the model selected. Each leg 6 which is rigidly connected to the associated tube 4 carries at its upper part a means for gripping the leg of a chair, the means comprising a base 7 and an abutment in the form of a corner 8 disposed on the base oppositely to the direction of action of the force of the spring 5. In other words, the upstanding flanges making up the corner 8 are capable partially to surround the leg of a chair placed on the base 7. The legs 6 may optionally be adjustable in height.

The connection between the leg 6 and the tube 4 is obtained by any means, such as a tenon and mortise joint, welding, by means of adhesive and maintenance by the tension of the spring 5.

To facilitate transport it is convenient to articulate the cross-bars 2, 2' around a vertical pivot pin 9. The overall length of the cross-bars 2 or 2' may vary from about 0.4 meters to 0.8 m in extension.

In order that the base of each leg should have a sufficient surface area, e.g. a quarter of a circular segment of 3–5 cm radius, the apparatus according to the invention is adaptable to different cross-sections of chair leg and is instantaneously adaptable to different base configurations of the chair.

The assembly on a chair to be raised is extremely simple. The chair to be furnished with the device is turned over, e.g. on a table. The apparatus is then upside-down. The cross-bars are pulled so as to extend them and are locked on to the chair legs by releasing them such that the base and the abutments partially surround the legs of the chair. It then suffices to turn the chair over again in order to utilise it in its raised position.

All rigid materials, such as wood, metal, synthetic materials are suitable for constructing the legs and their base.

What I claim is:

1. A device for raising a chair of the type having at least four legs, said device comprising:

first and second hollow tubular beams each having a mid-point and opposite open ends, a pivot pin passing through both said mid-points of said first and second tubular beams so that said beams are freely rotatable about said pivot pins in planes extending substantially parallel to each other, an extension beam for each end of said first and second hollow tubular beams, said extension beams having opposite open ends and a leg member rigidly secured to one of said ends of each extension beam, each end of said first and second tubular beams having the said other end of a said extension beam inserted therein, each said extension beam having a cross-sectional area that is slightly smaller than the cross-sectional area of its associated hollow tubular beam so that each said extension beam is movable into and out of its associated hollow tubular beam, said leg members secured to each said one end of said extension beams being disposed to extend substantially perpendicular to each associated extension beam, each leg member having, at one end thereof, corner means for engaging a leg of a chair, at least four coil springs, each coil spring having a first and a second end, each hollow tubular beam and associated inserted extension beam having a said coil spring disposed therein extending from said pivot pin to said leg member, with said first end of each coil spring connected to the pivot pin and said second end of each said coil spring being connected to the end of the extension beam in which said coil spring is disposed whereby said coil springs will exert a constant force tending to retract each said respective extension beam into its associated tubular beam.

* * * * *